US007295164B1

(12) United States Patent
O'Loughlin

(10) Patent No.: US 7,295,164 B1
(45) Date of Patent: Nov. 13, 2007

(54) CONTROL OF THE FRESNEL MAXIMUM OF AN APERTURE ANTENNA

(75) Inventor: James P. O'Loughlin, Placitas, NM (US)

(73) Assignee: The United States of America as Represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 11/271,607

(22) Filed: Nov. 10, 2005

(51) Int. Cl.
*H01Q 3/00* (2006.01)

(52) U.S. Cl. ..... 343/703

(58) Field of Classification Search ..... 343/767, 343/840, 786, 703, 781 R, 753; 342/359
See application file for complete search history.

(56) References Cited

U.S. PATENT DOCUMENTS 7,126,530 B2 * 10/2006 Brown ..... 342/359

OTHER PUBLICATIONS

Balanis, "Antenna Theory: Analysis and Design", 1982, pp. 459-466.*

* cited by examiner

*Primary Examiner*—Michael C. Wimer
(74) *Attorney, Agent, or Firm*—Kenneth E. Callahan

(57) ABSTRACT

The maximum peak power density of an aperture antenna that occurs in the near field region relative to the average power density concentration at other ranges within the entire near field is increased by lowering the aspect ratio of the aperture antenna, whereby the transmitter power can be increased and the operating range and performance of the system improved for applications that operate in the near field.

3 Claims, 6 Drawing Sheets

CONTROL OF THE FRESNEL MAXIMUM OF AN APERTURE ANTENNA

STATEMENT OF GOVERNMENT INTEREST

The conditions under which this invention was made are such as to entitle the Government of the United States under paragraph I(a) of Executive Order 10096, as represented by the Secretary of the Air Force, to the entire right, title and interest therein, including foreign rights.

BACKGROUND OF THE INVENTION

The invention relates generally to the field of aperture antennas, and more specifically provides a means of reducing the maximum peak power density of an aperture antenna that occurs in the near field region relative to the average power density concentration at other ranges within the entire near field.

Microwave transmitting antennas of the aperture type operating at millimeter wavelengths have an equivalent aperture diameter of many wavelengths that defines a near field region extending as far as hundreds of meters. Applications that operate in the near field, such as Active Denial Technology (ADT), require antennas that produce power density characteristics that are compatible with the application requirements. There is a difficulty with applications that require a power density that lies between a minimum level, $P_1$ and a maximum level $P_2$, in that there exists a peak power density at a range in the near field commonly referred to as the Fresnel maximum that sets the limit at $P_2$ and constricts the depth of ranges that will remain above the minimum level $P_1$. The power density in the near field is calculated using scalar potential theory which is well understood by those skilled in the art. A plot of the power density on the boresight of a square aperture antenna with uniform illumination vs. range is shown in FIG. 1. The aperture is one meter square with a total illumination of 1-kW at a frequency of 100 GHz. The phase front at the aperture has zero curvature corresponding to an infinite focal length. The range of the near field boundary (RNFB) at which the field of the antenna transitions from the near field to the far field is typically approximated by the relation:

$$RNFB \cong \frac{4A}{\pi\lambda} \qquad \text{[Eq. 1]}$$

Where, A is the area of the aperture in square meters and A is the wavelength in meters. The antenna in FIG. 1 has a RNFB of 403 meters.

In FIG. 1 the Fresnel peak is at a range of about 125 meters and amplitude of about 3250 W/m$^2$. It is obvious that the maximum allowable peak power density of the system is determined by the Fresnel peak. This in turn determines the ranges over which the minimum required power density is available. Clearly, if the peak power density at the Fresnel maximum could be reduced without significant changes to the remainder of the power profile, then the transmitter power could be increased, and the operating range and performance of the system would increase.

SUMMARY OF THE INVENTION

The aspect ratio of an aperture antenna of any shape is increased to reduce the maximum peak power density in the near field. For applications that operate in the near field, a reduced peak power density (Fresnel maximum) permits an increase in transmitter power and a consequent improvement in operating range and performance of the system.

DESCRIPTION OF THE PREFERRED EMBODIMENT

Figure 1:
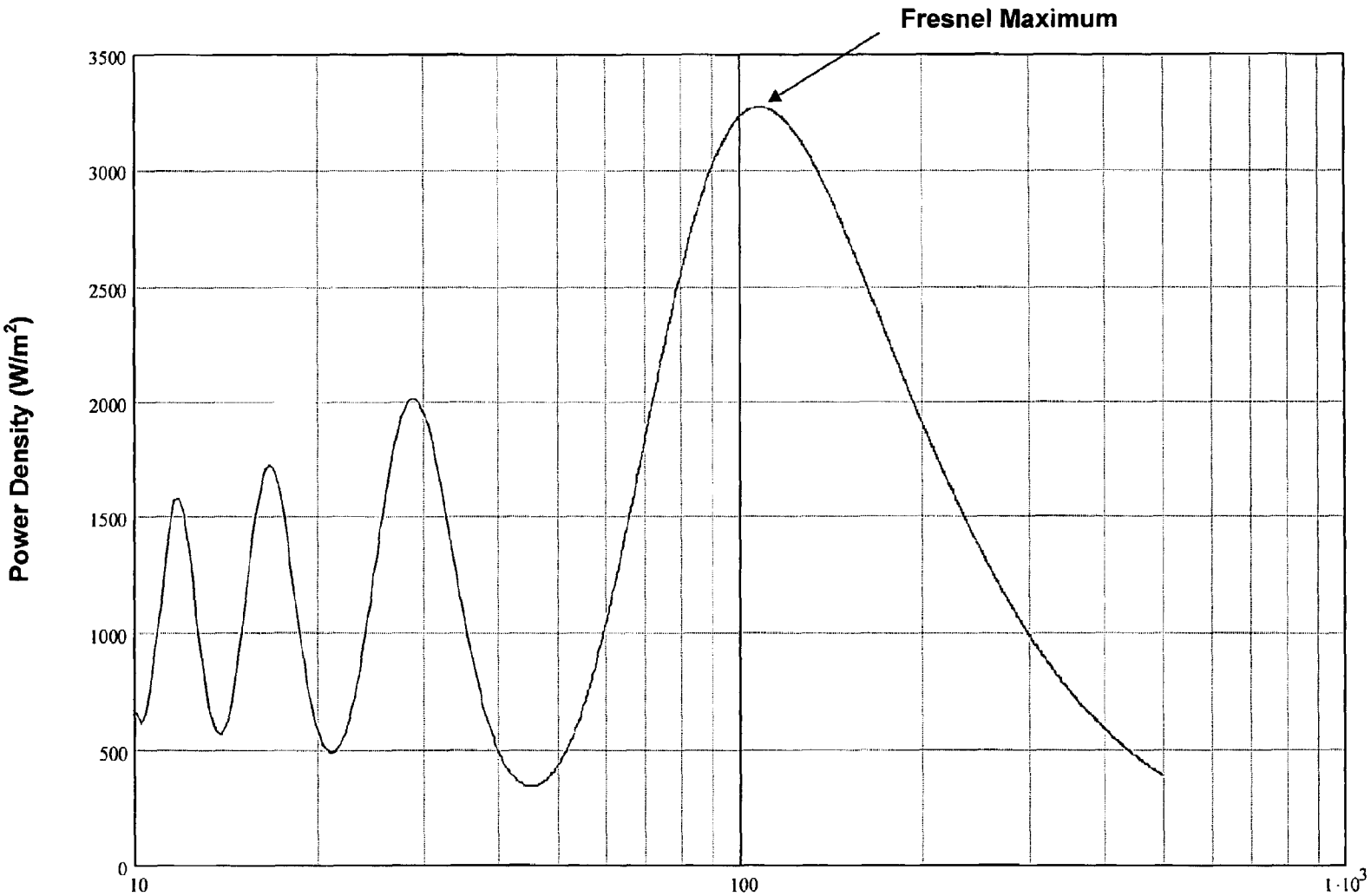
FIG. 1 is a plot of the power density on the boresight vs. range in the near field of a square aperture antenna with uniform illumination.
Figure 2:
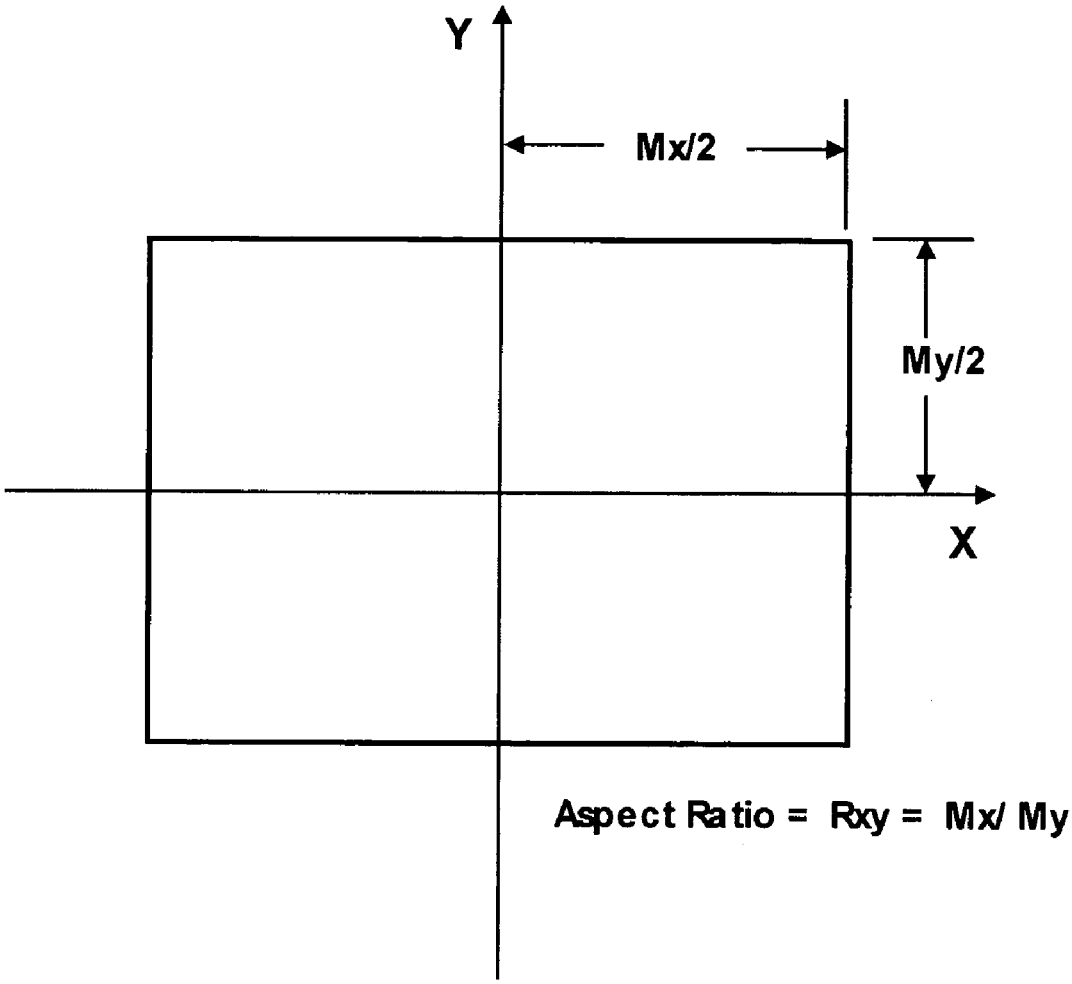
FIG. 2 shows a rectangular-shaped aperture antenna with aspect ratio defined.

If instead of a square aperture a rectangular shape as shown in FIG. 2 is used, calculations show that the position and relative magnitude of the Fresnel maximum change as the aspect ratio of the rectangle is changed. The aspect ratio, Rxy, is defined as the ratio of the larger dimension, Mx, of the aperture to the smaller dimension, My. When Rxy=1 the aperture is a square. For simplicity, in the examples described, x is taken as the larger and y as the smaller; however, the reduction of the Fresnel maximum depends only upon the ratio and not the orientation or rotation of the aperture.

Figure 3:
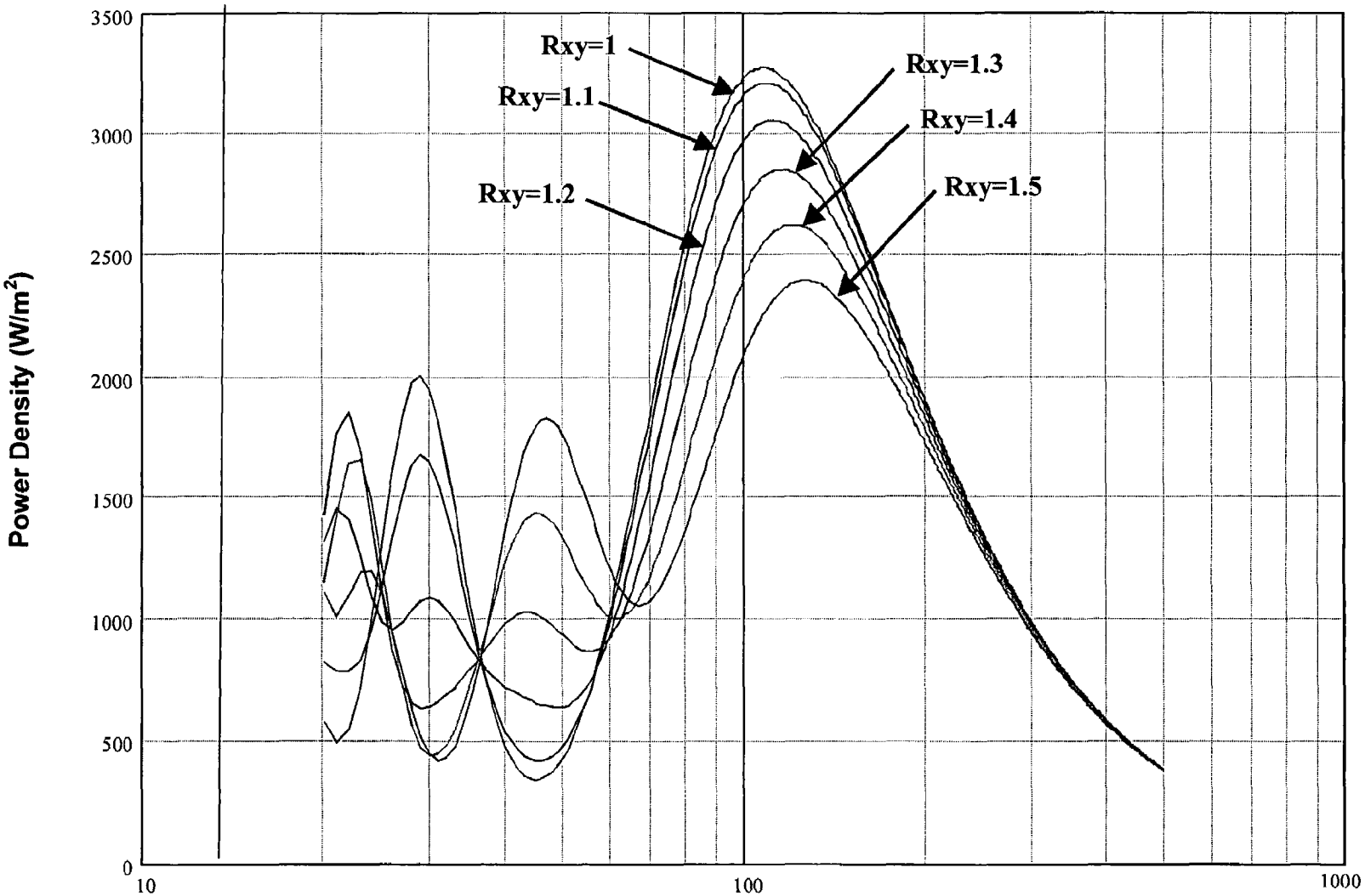
FIG. 3 is a plot of the power density on the boresight vs. range in the near field of a rectangular aperture antenna with uniform illumination and varying aspect ratios.

The calculated boresight power density as a function of range is shown in FIG. 3 for values of aperture ratio, Rxy of 1.0, 1.1, 1.2, 1.3, 1.4 and 1.5. The aperture area is held at 1 m$^2$ at a frequency of 95 GHz and it is uniformly illuminated with 1 kW.

The data in FIG. 3 clearly shows that as the aspect ratio increases there results a significant decrease in the peak power density at the Fresnel maximum. In addition, the power density levels at other ranges remain approximately within the previous bounds established by the square aperture, Rxy=1. At ranges greater that the Fresnel Maximum, the beam consists of a single central peak that falls off in intensity with smooth side lobes. This is true for all aspect ratios. The aspect ratio does relate to the cross-sectional shape of the spot, in that it displays an aspect ratio similar to the aperture at the Fresnel Peak and transitions into an aspect ratio that is also similar to the aspect ratio of the aperture but rotated by 90 degrees as the range approaches the RNFB and greater ranges.

Figure 4:
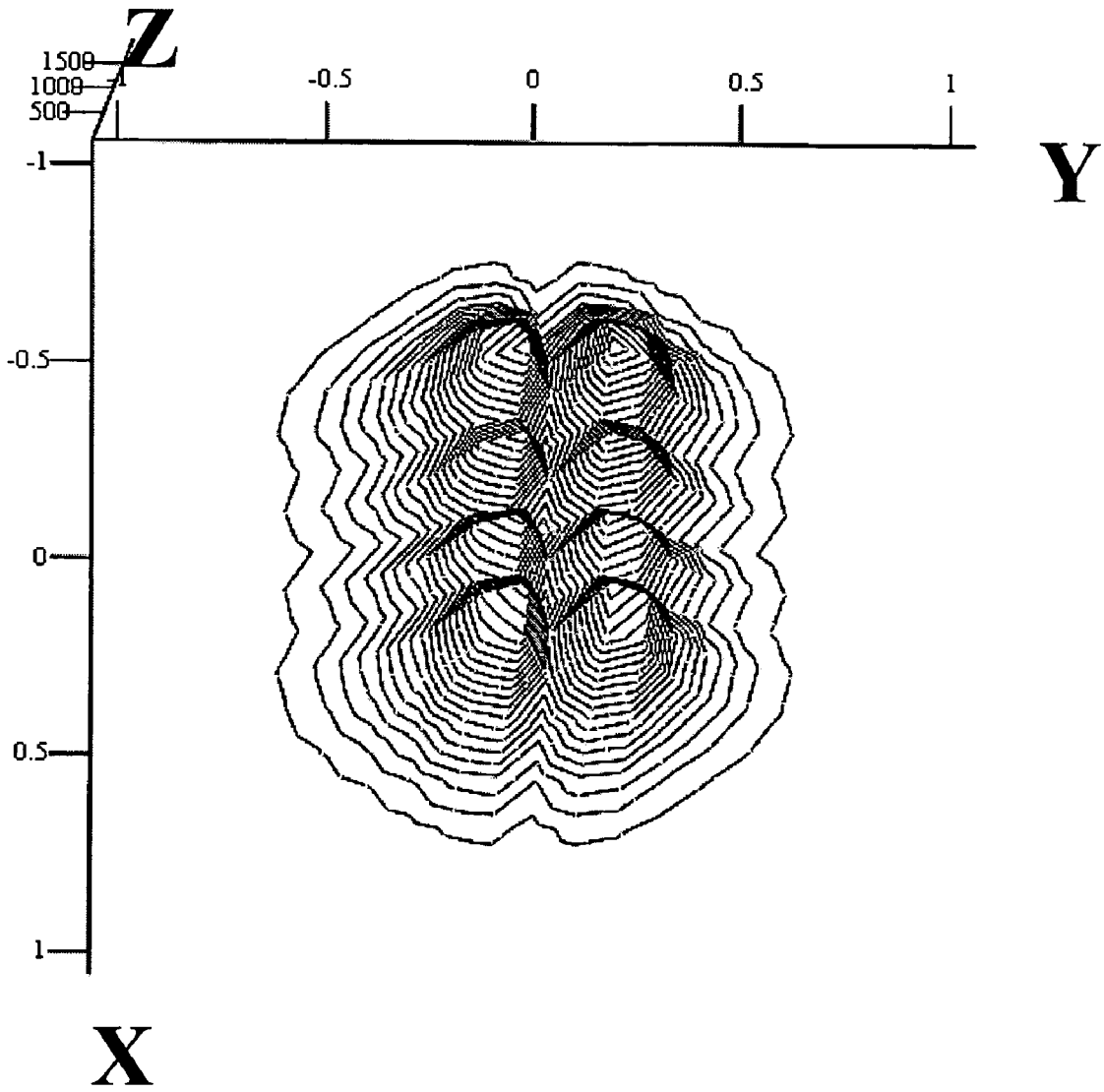
FIG. 4 is a 3-D representation of the multi-peak beam profile of the aperture antenna in FIG. 3 at a range of 30 meters and an aspect ratio of Rxy=1.4.

At ranges less than the Fresnel Peak, the beam pattern develops mode patterns that consist of multiple peaks grouped within a cross-sectional area that has an aspect ratio similar to the aperture. These multiple mode peaks do not develop peak power intensities that exceed that which is developed at the peaks on the boresight axis. An example of the multiple mode peak structure is shown in FIG. 4 in a three dimensional representation of the aperture of FIG. 3 at a range of 30 meters and an aspect ratio of Rxy=1.4. The aperture dimensions are Mx=1.183 m and My=0.845 m. The aspect ratio of the beam pattern in FIG. 4 has about the same aspect ratio, being about 1.4 meter in the x dimension and 1 meter in the y dimension.

Figure 5:
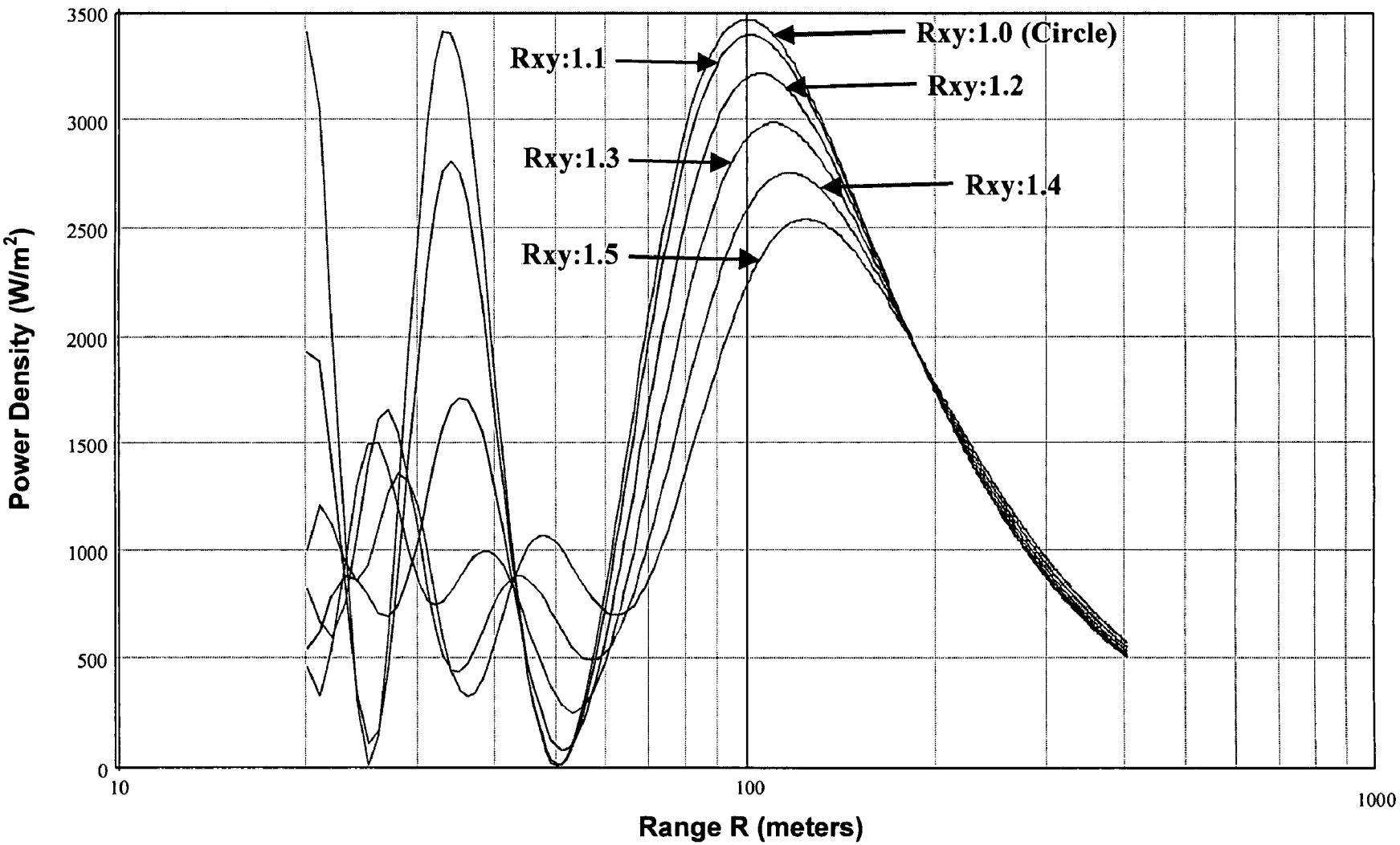
FIG. 5 is a plot of power density vs. range for an antenna aperture area of 1 m$^2$ with aspect ratios of Rxy=1.0 (circle), 1.1, 1.2, 1.3, 1.4, and 1.5 (ellipses).
Figure 6:
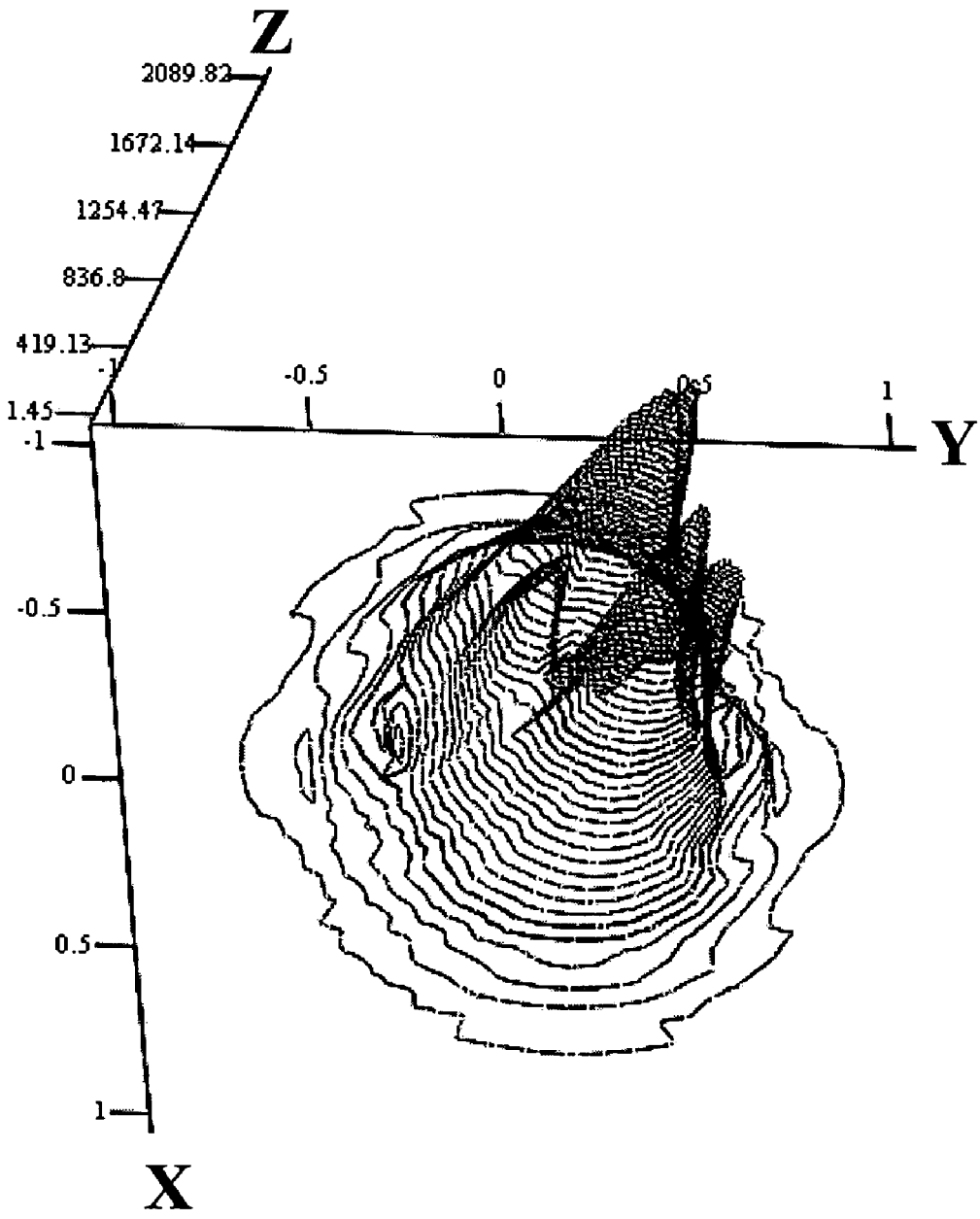
FIG. 6 is a 3-D representation of the multi-peak beam profile of the elliptical aperture antenna in FIG. 5 at a range of 62 meters and an aspect ratio of Rxy=1.4.

The decrease of the Fresnel maximum with increasing aspect ratio occurs with any shape aperture, not only the rectangular shape as discussed above. To illustrate, the characteristics of a circular aperture that is progressively shaped into an ellipse are shown in FIG. 5. In FIG. 5 the plot of power density vs. range is for an aperture area of 1-$M^2$ for aspect ratios of Rxy=1.0 (circle), 1.1, 1.2, 1.3, 1.4, and 1.5 (all ellipses). FIG. 6 is a 3-D representation of the multi-peak beam profile of the elliptical aperture antenna in FIG. 5 at a range of 62 meters and an aspect ratio of Rxy=1.4. The behavior of the elliptical-type of antenna is shown to be similar to a rectangular antenna in terms of the Fresnel Peak being lower by comparison of FIG. 3 and FIG. 5. Also, the multiple mode patterns of the beam minor peaks and the over-all aspect ratio of the beam is similar as shown by FIG. 4 and FIG. 6.

In fact, increasing the aspect ratio of any geometric or other shaped aperture antenna will result in lowering the Fresnel peak without producing significant changes to the remainder of the power profile of the antenna. As a consequence, the transmitter power can be increased thereby increasing the operating range and performance of the system.

The invention claimed is:

1. A method for reducing the maximum peak power density, defined as the Fresnel Maximum, on the boresight of an aperture antenna designed to operate within the Fresnel region that does not significantly change the minimum power density level on boresight at other ranges within the Fresnel region and that is applicable to aperture antennas having an equivalent aperture diameter range of 100 to 3000 wavelengths, the method comprising increasing the aspect ratio of the aperture antenna defined as the ratio of the larger dimension to the lesser dimension, whereby the transmitter power may be increased and the operating range and performance of the system improved for applications that operate within the Fresnel region.

2. The method of reducing the maximum peak power density of an aperture antenna operating in the Fresnel region of claim 1, wherein the aspect ratio of a square aperture antenna is increased to form a rectangular-shaped antenna aperture.

3. The method of reducing the maximum peak power density of an aperture antenna operating in the Fresnel region of claim 1, wherein the aspect ratio of a circular aperture antenna is increased to form an elliptical-shaped antenna aperture.

* * * * *